United States Patent [19]

Gajjar

[11] Patent Number: 4,688,403

[45] Date of Patent: Aug. 25, 1987

[54] METHOD OF WARP KNITTING

[75] Inventor: Bharat J. Gajjar, Wilmington, Del.

[73] Assignee: E. I. Du Pont de Nemours and Company, Wilmington, Del.

[21] Appl. No.: 929,086

[22] Filed: Nov. 10, 1986

[51] Int. Cl.[4] ..... D04B 21/00

[52] U.S. Cl. ..... 66/195; 66/202

[58] Field of Search ..... 66/190, 192, 193, 195, 66/202

[56] References Cited

U.S. PATENT DOCUMENTS 3,910,075 10/1975 Holliday ..... 66/192

3,931,721 1/1976 Adamson ..... 66/195

4,307,587 12/1981 Baesgen et al. ..... 66/195

*Primary Examiner*—Ronald Feldbaum

[57] ABSTRACT

A warp knitted fabric of elastomeric and nonelastomeric threads. The nonelastomeric threads are fed from a single warp in a pattern to the front bar while the elastomeric threads are divided into a plurality of sets from a single warp and fed to a plurality of guide bars in a pattern. The guide bars with the elastomeric threads are knit in a repeating stitch pattern having a combination of knit and laid-in stitches for each elastomeric thread.

4 Claims, 25 Drawing Figures

METHOD OF WARP KNITTING

BACKGROUND OF THE INVENTION

This invention relates to warp knitted fabrics and more particularly to a method of knitting the fabrics with elastomeric and nonelastomeric threads to produce surface interest.

Basic warp knitting to which this invention applies comprises knitting on (e.g. tricot or Raschel) warp knit machines and when knitting fabrics of elastomeric and nonelastomeric basically two stitch constructions are used with the elastomeric yarn. They are: (1) a closed loop stitch construction on a tricot machine as shown in U.S. Pat. No. 3,069,895 and (2) a laid-in stitch construction on a Raschel machine as disclosed in U.S. Pat. No. 3,552,154. Fabrics made using these stitch constructions with elastomeric yarns are characterized by smooth surfaces with no surface interest. The prior art includes many techniques for forming surface patterns in warp knitted fabrics but these known techniques involve complicated variation in stitch patterns, the laying in of extra ends in pattern forming arrays or like complications which diminish productivity and add to the fabric cost.

SUMMARY OF THE INVENTION

This invention provides a method for preparing fabrics with elastomeric and nonelastomeric yarns that have surface interest, that can be made on a tricot or Raschel machine at a low cost with an enlarged range of surface interest.

The method provides these above-noted advantages when warp knitting nonelastomeric threads (e.g. nylon and textured polyester) and elastomeric threads from material such as spandex. The nonelastomeric threads are fed from a single top beam or warp to a first guide gar in a pattern and knit in a stitch pattern of knit stitches. The elastomeric threads are supplied from a single beam or warp that are divided into a plurality of sets of elastomeric threads and fed to a plurality of guide bars in a pattern and the guide bars threaded with the elastomeric threads are knit (e.g., single needle or double needle; open or closed stitches) in a repeating stitch pattern having a combination of a knit stitches and a laid-in stitches for each elastomeric thread.

DETAILED DESCRIPTION OF THE ILLUSTRATED EMBODIMENTS

Figure 1:
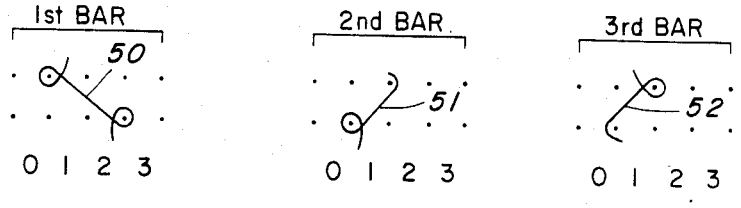
FIGS. 1–18 are stitch pattern diagrams for the fabrics of this invention.
Figure 2:
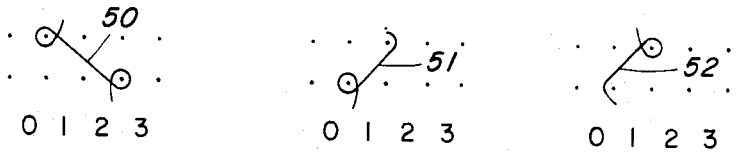
Figure 3:
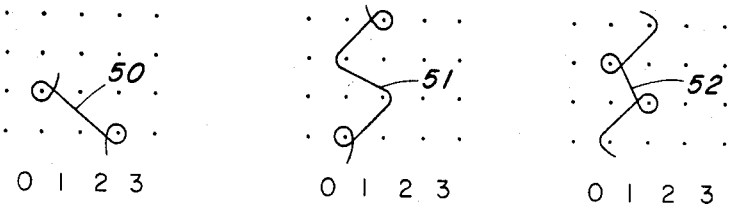
Figure 4:
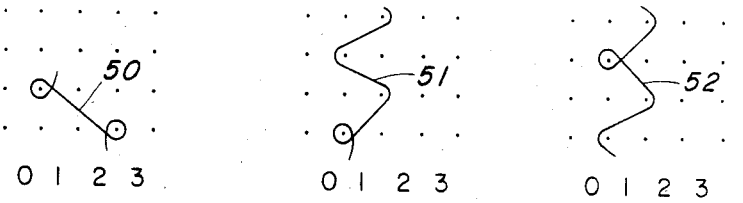
Figure 5:
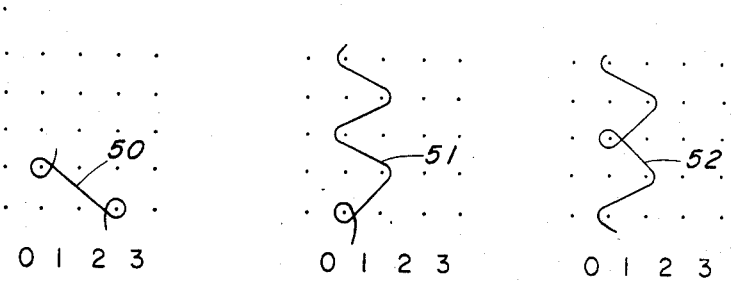
Figure 6:
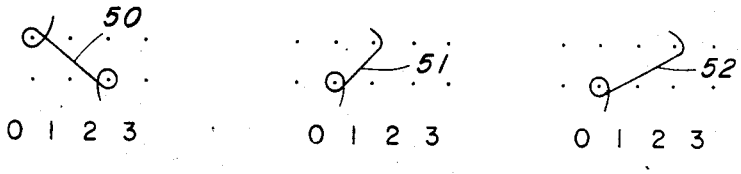
Figure 7:
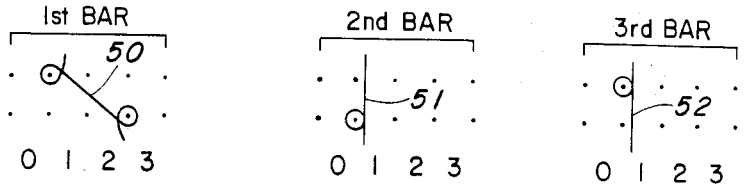
Figure 8:
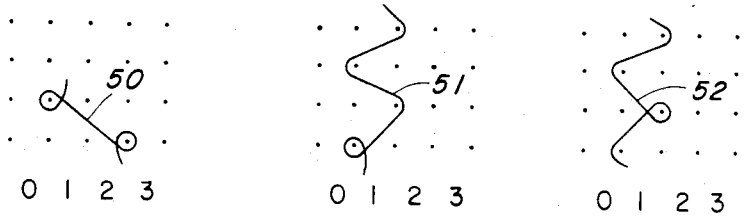
Figure 9:
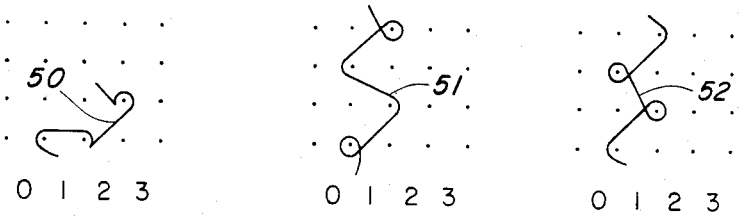
Figure 10:
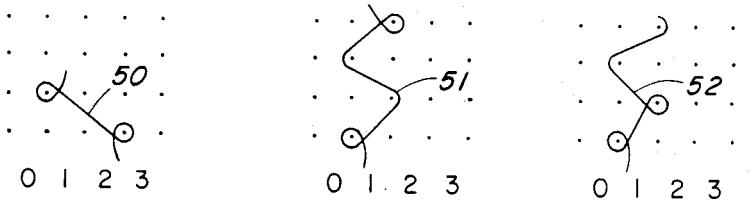
Figure 11:
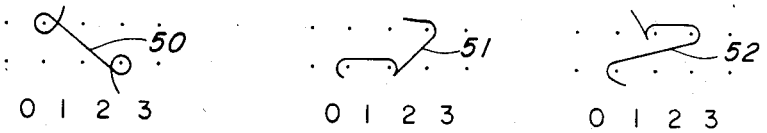
Figure 12:
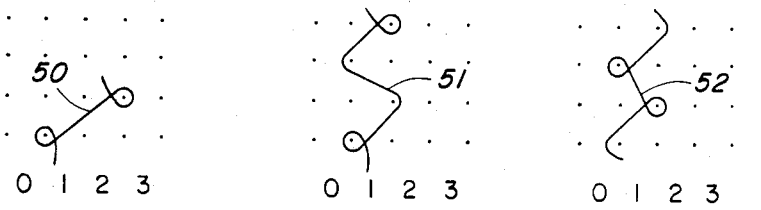
Figure 13:
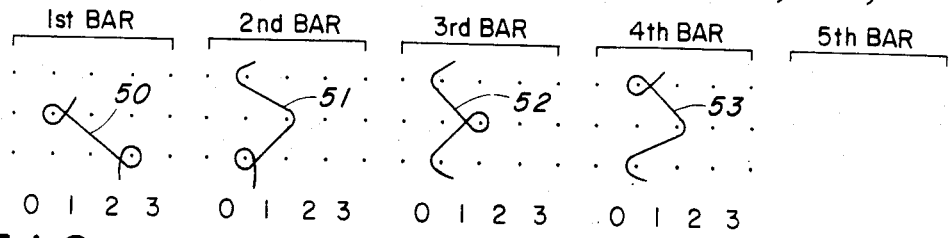
Figure 14:
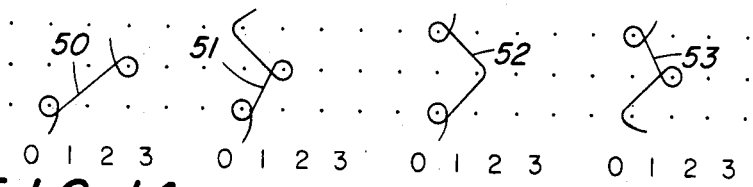
Figure 15:
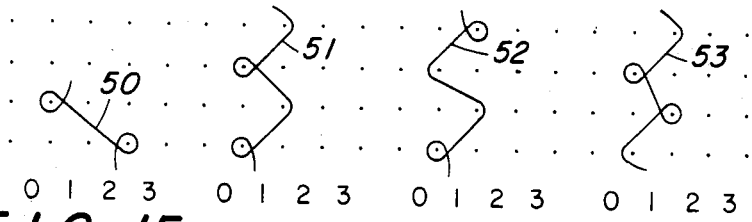
Figure 16:
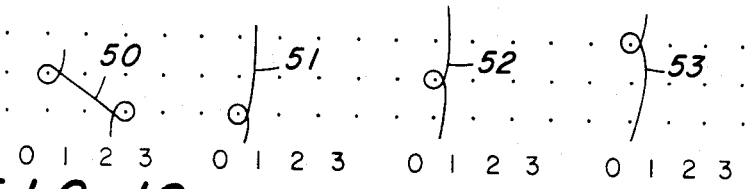
Figure 17:
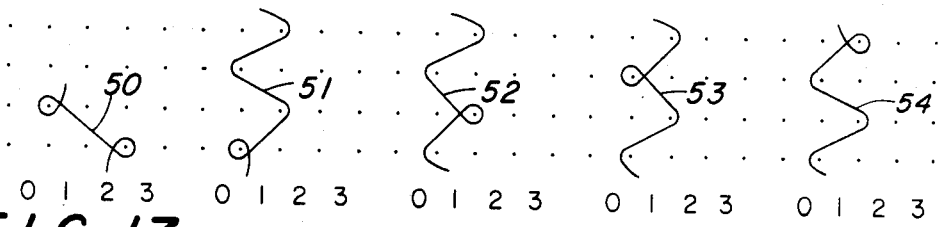
Figure 18:
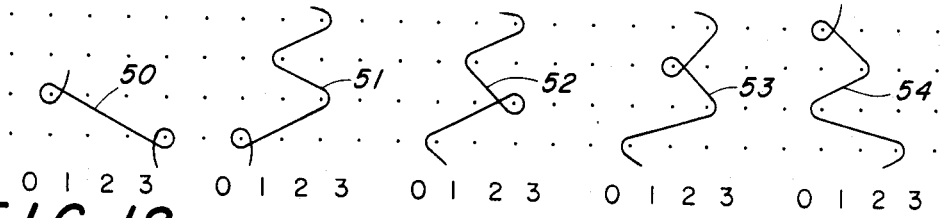

The invention is best defined in terms of stitch patterns as shown in FIGS. 1 to 18 for warp knit fabrics of elastomeric combined with nonelastomeric yarns. For each of the Figs. represented a single needle-bar is normally employed, being fed from a front or first bar of nonelastomeric knitting yarns such as nylon yarn and a plurality of back bars of elastomeric knitting yarns such as spandex yarn. Knitting needle positions for each of a plurality of successive courses are represented in the diagrams by horizontal lines of dots, the top line representing the course formed immediately after the course represented by the bottom line. One first or front-bar end and two or more other bar ends are shown in each instance, it being understood that one end of each is knitted on each knitting needle for every course. More particularly, referring to FIG. 1 the stitch construction of the fabric is notationally set out and shows that the threads of the first or front bar, one of which is indicated at 50, have back-and-forth movement to nonadjacent needles in successive courses as indicated by the numbers 2-3, 1-0 and that the threads of the second and third bars 51,52 have similar movements as indicated by the numbers (1-0, 2-2); (0-0, 1-2) respectively. The second and third bar threads of elastomeric yarns 51,52 are a two course repeat of knit and laid-in stitches while the first bar threads of nonelastomeric yarns are knit stitches in the constructions of the instant invention. FIGS. 13–18 illustrate four and five guide bar stitch construction wherein the fourth and fifth guide bar threads 53,54 are also elastomeric and are combinations of knit and laid-in construction.

The fabric is preferably made according to the invention on a tricot or similar warp knitting machine employing a single needle bar and at least three guide bars respectively known as the back middle and front guide bars. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both bars are also swingable transversely of the needle bar to permit their yarn guides to pass between the needles, the combined shogging and swinging movements permitting the yarns to be fed to the needles and to be knit thereby.

Figure 19:
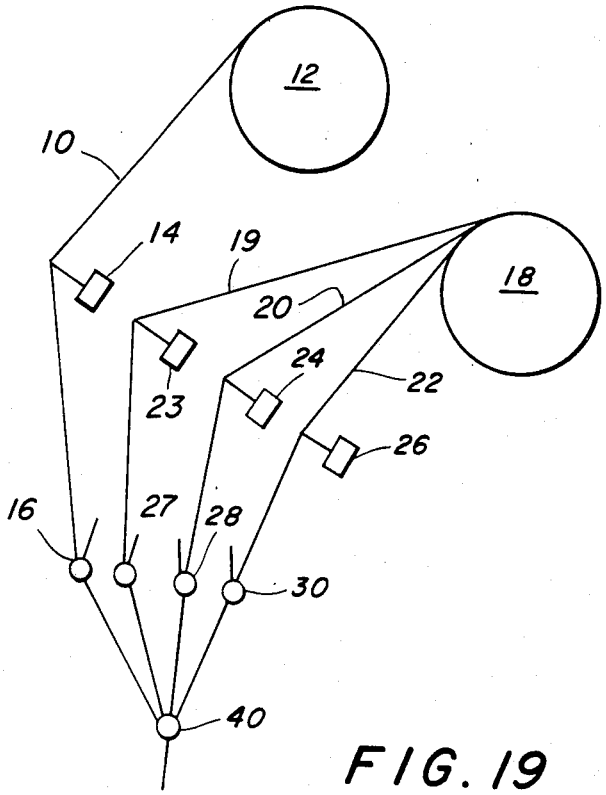
FIG. 19 is a schematic end elevation view of the apparatus elements for warp knitting the fabrics of this invention.

The schematic illustration for such a warp knitting machine is shown in FIG. 19. The front or first guide bar warp is fed from nonelastomeric threads 10 on beam 12. The threads 10 pass in the usual well-known manner through a fixed reed 14 which serves to keep the threads separated. From the reed each thread 10 is threaded through its guide in guide bar 16 and on to needle bed 40. The elastomeric threads on beam 18 are divided into three sets of threads 19,20,22 which are fed through respective fixed reeds 23,24,26 and second, third and fourth guide bars 27,28,30 to needle bed 40. Alternatively, threads 19,20 and 22 could be fed from individual beams. It should be understood that the front beam could be split and/or fully or partially threaded.

Figure 20:
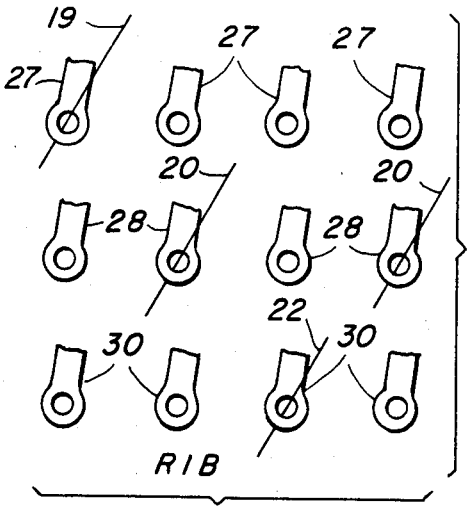
FIGS. 20 and 21 are schematic diagrams of guide bar threading useful with this invention.
Figure 21:
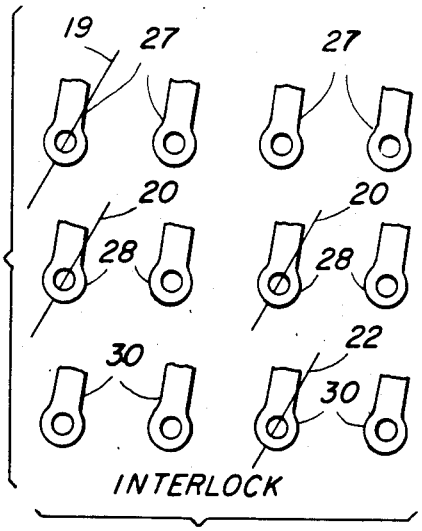
Figure 22:
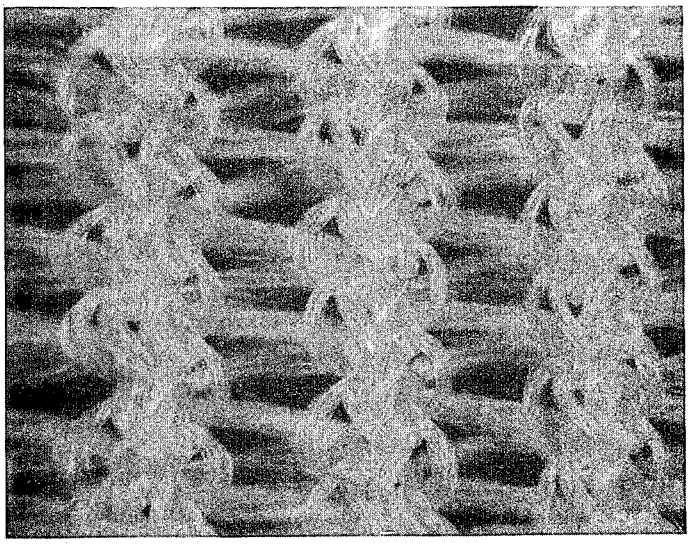
FIGS. 22–25 are photographs of loop sides of fabric made as described in Example I and magnified 25 times.
Figure 23:
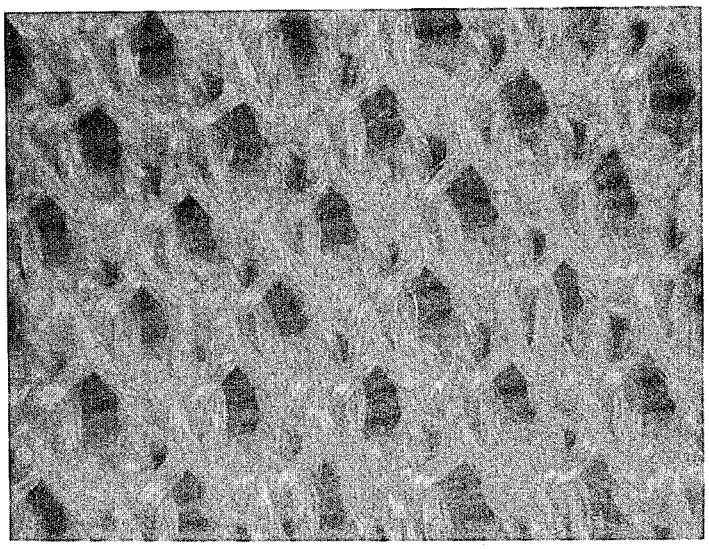
Figure 24:
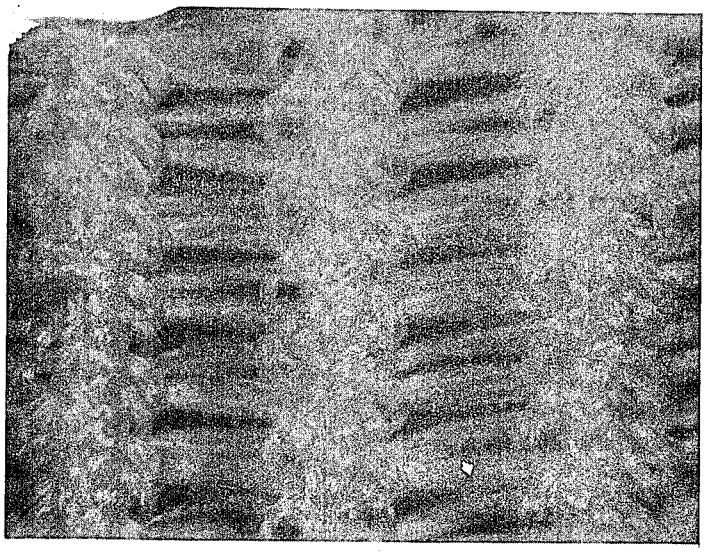
Figure 25:
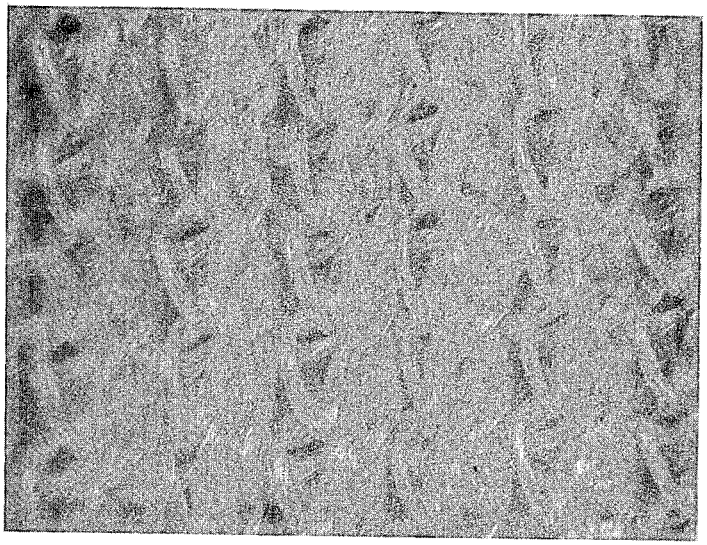

The provision of warpwise line patterns in the warp knitted fabrics of this results from basic multi-bar warp knitting with patterned threading of the guide bars as illustrated in FIGS. 20 and 21 wherein the second guide bar 27 in FIG. 20 is threaded with threads 19 (1 in and 3 out); the third guide bar 28 is threaded with threads 20 (1 out, 1 in); and the fourth guide bar 30 is threaded with threads 22 (2 out, 1 in, 1 out) to form what is known as rib-type threading.

Similarly in FIG. 21, guide bar 27 is threaded (1 in, 3 out) with threads 19; guide bar 28 is threaded (1 in, 1 out) with threads 20; and guide bar 30 is threaded (2 out, 1 in, 1 out) with threads 22 to form what is known as interlock type threading. These are two patterns of threading and many others will occur to those skilled in the art.

The movements of needles through successive courses are indicated below each diagram by their numbers (FIGS. 1–18) as set forth in Table I.

TABLE I

| FIG. No. | Fabric No. | TOP BEAM Front or* 1st Bar | BOTTOM BEAM Middle or 2nd Bar | Back or 3rd Bar | 2nd & 3rd Guidebar threading | TYPE STITCHES |
|---|---|---|---|---|---|---|
| 1 | AB | 2-3,1-0 | 1-0,2-2 | 0-0,1-2 | FIG. 20 | 1 Knit 1 Laid-in |
| 2 | AA | 2-3,1-0 | 1-0,2-2 | 0-0,1-2 | FIG. 21 | 1 Knit 1 Laid-in |
| 3 | BB | 2-3,1-0 | 1-0,2-2,0-0,1-2 | 0-0,1-2,1-0,2-2 | FIG. 20 | 2 Knit 2 Laid-in |
| 3 | BA | 2-3,1-0 | 1-0,2-2,0-0,1-2 | 0-0,1-2,1-0,2-2 | FIG. 21 | 2 Knit 2 Laid-in |
| 4 | CB | 2-3,1-0 | 1-0,2-2,0-0,2-2 | 0-0,2-2,1-0,2-2 | FIG. 20 | 1 Knit 3 Laid-in |
| 4 | CA | 2-3,1-0 | 1-0,2-2,0-0,2-2 | 0-0,2-2,1-0,2-2 | FIG. 21 | 1 Knit 3 Laid-in |
| 5 | DB | 2-3,1-0 | 1-0,2-2,0-0,2-2,0-0 | 0-0,2-2,1-0,2-2,0-0 | FIG. 20 | 1 Knit 4 Laid-in |
| 6 | EB | 2-3,1-0 | 1-0,2-2 | 1-0,3-3 | FIG. 20 | 1 Knit 1 Laid-in |
| 7 | FB | 2-3,1-0 | 1-0,1-1 | 1-1,1-0 | FIG. 20 | 1 Knit 1 Laid-in |
| 8 | GB | 2-3,1-0 | 1-0,2-2,0-0,2-2 | 0-0,1-2,0-0,2-2 | FIG. 20 | 1 Knit 3 Laid-in |
| 9 | HB | 0-2,3-2 | 1-0,2-2,0-0,1-2 | 0-0,1-2,1-0,2-2 | FIG. 20 | 2 Knit 2 Laid-in |
| 10 | IB | 2-3,1-0 | 1-0,2-2,0-0,1-2 | 1-0,1-2,0-0,2-2 | FIG. 20 | 2 Knit 2 Laid-in |
| 11 | JB | 2-3,1-0 | 0-2,3-3 | 0-0,3-2 | FIG. 20 | 1 Knit 1 Laid-in |
| 12 | KB | 1-0,2-3 | 1-0,2-2,0-0,1-2 | 0-0,1-2,1-0,2-2 | FIG. 20 | 2 Knit 2 Laid-in |

| FIG. No. | Fabric No. | 1st or Front Bar | 2nd Bar | 3rd Bar | 4th Bar | 5th or Back Bar |
|---|---|---|---|---|---|---|
| 13 | LB | 2-3,1-0 | 1-0,2-2,0-0 | 0-0,1-2,0-0 | 0-0,2-2,1-0 | — |
| 14 | MB | 1-0,2-3 | 1-0,1-2,0-0 | 1-0,2-2,1-0 | 0-0,1-2,1-0 | — |
| 15 | NB | 2-3,1-0 | 1-0,2-2,1-0,2-2 | 1-0,2-2,0-0,1-2 | 0-0,1-2,1-0,2-2 | — |
| 16 | OB | 2-3,1-0 | 1-0,1-1,1-1 | 1-1,1-0,1-1 | 1-1,1-1,1-0 | — |
| 17 | PB | 2-3,1-0 | 1-0,2-2,0-0,2-2 | 0-0,1-2,0-0,2-2 | 0-0,2-2,1-0,2-2 | 0-0,2-2,0-0,1-2 |
| 18 | QB | 3-4,1-0 | 1-0,3-3,1-1,3-3 | 0-0,2-3,1-1,3-3 | 0-0,3-3,2-1,3-3 | 3-3,0-0,2-2,1-0 |

*Fully threaded

EXAMPLE

A tricot warp knitting machine was employed to produce five fabrics as identified in Table II as fabric Nos. IIA through IIE.

Fabric IIF is the jersey tricot control fabric exhibiting a smooth flat surface. Fabrics IIA–IIE of this invention have particularly attractive patterning as shown in FIGS. 22 through 25.

The test methods for determining thickness, bulk, static extension, air permeability and power, and finishing procedures for the fabrics are detailed below.

TEST METHODS

Thickness is measured according to ASTM D1777-64 using apparatus commercially available from Customer Scientific Instruments, Inc., Whippany, NJ. Thickness is measured in inches.

Bulk (specific volume) is calculated according to the formula:

$$\text{Bulk (cm}^3\text{/g)} = \frac{2.54 \times 8361 \times T}{28.35\ W}$$

wherein

T = Thickness (inches)

W = Weight (g/cm$^2$)

Static Extension Test determines fabric elongation and growth. Measurements are made using a Model C5138 static extension tester available from Customer Scientific Instrument Co., Kearny, NJ.

Test Stretch is the length of a fabric sample while under a load of 2 lb. per inch fabric width expressed as a percentage of original relaxed length.

Growth is measured by holding a fabric sample at 180% of its relaxed length for two hours, then measuring its relaxed length after one munute and again after one hour. Growth is expressed as percentages of original relaxed fabric length.

Air Permeability is the rate of air flow through the fabric under a differential pressure between the two fabric surfaces and expressed in cubic feett of air per minute per square foot of fabric. It is measured in accordance with ASTM method D737-75.

FINISHING PROCEDURE

Step 1—Steam the fabrics.

Step 2—Heat set the fabrics on the Pin Tenter at 375° F. 4 boxes—50 secs. 7% overfeed and 7% over with the greige fabric.

Step 3—Beck scour and dye the fabrics

Step 4—Dry on the Pin Tenter at 290° F. 30 yds/min and set the Pin Tenter at the fabric's wet width.

TABLE II

FABRIC CONSTRUCTION AND GREIGE FABRIC PROPERTIES (A) FABRIC CONSTRUCTION

| Fabric No. | Top Beam Warp | Bottom Beam Warp | Stitch Construction: Top Beam Warp Front Bar | Bottom Beam Warp Middle Bar | Bottom Beam Warp Back Bar |
|---|---|---|---|---|---|
| IIA | 40-26 T875AB | 70d T126 Lycra | 2-3,1-0 | 1-0,2-2,0-0,1-2 | 0-0,1-2,1-0,2-2 |
| IIB | 40-26 T875AB | 70d T126 Lycra | 2-3,1-0 | 1-0,2-2,0-0,1-2 | 0-0,1-2,1-0,2-2 |
| IIC | 40-26 T875AB | 70d T126 Lycra | 2-3,1-0 | 1-0,2-2 | 2-2,1-0 |
| IID | 40-26 T875AB | 70d T126 Lycra | 2-3,1-0 | 1-0,2-2 | 2-2,1-0 |
| IIE | 40-13 T865 Nylon | 40d T126 Lycra | 2-3,1-0 | 1-0,1-1 | 1-1,1-0 |
| IIF | 40-13 T865 Nylon | 40d T126 Lycra | 2-3,1-0 | 1-0,1-1 | 1-0,1-2 |

(B) FABRIC CONSTRUCTION AND GREIGE FABRIC PROPERTIES

TABLE II-continued

FABRIC CONSTRUCTION AND GREIGE FABRIC PROPERTIES

| Fabric No. | Quality | Ratio FB//MB//BB | Type Guide Bar Threading | gm Ten/3 ends | Weight oz/yd2 |
|---|---|---|---|---|---|
| IIA | 7½" | 64"//19¾"//19¾" | Interlock | 10 | 2.8 |
| IIB | 7½" | 64"//19¾"//19¾" | Rib | 10 | 4.3 |
| IIC | 9½" | 76"//15.5"//15.5" | Interlock | 10 | 3.3 |
| IID | 9½" | 76"//15.5"//15.5" | Rib | 10 | 4.7 |
| IIE | 7½" | 62"//9.2"//9.2" | Rib | 10 | — |
| IIF | 7½" | 58"//24" | — | 10 | — |

(C) FINISHED FABRIC PROPERTIES

| Fabric No. | Wt oz/yd2 | Count WPI × CPI | BSI Thickness | Bulk cc/g | % Stretch W × C | % Growth W × C | Air Permeability Cu Ft Min/Ft2 |
|---|---|---|---|---|---|---|---|
| IIA | 2.4 | 36 × 80 | .024 | 7.52 | 154 × 38 | 12 × 8 | 705 |
| IIB | 3.5 | 52 × 80 | .024 | 5.11 | 133 × 82 | 8 × 13 | 454 |
| IIC | 3.1 | 33 × 80 | .029 | 7.05 | 256 × 63 | 7 × 9 | 531 |
| IID | 4.9 | 62 × 92 | .036 | 5.50 | 157 × 187 | 14 × 11 | 269 |
| IIE | 2.5 | 30 × 128 | .020 | 6.00 | 375 × 49 | 25 × 3 | 339 |
| IIF | 5.2 | 66 × 100 | .029 | 4.19 | 164 × 124 | 14 × 6 | 269 |

While the invention has been illustrated using elastomeric yarns it should be understood that a stretchable textured yarn would provide similar surface effects. This technology is also useful for two needle bed warp knit machines; e.g., "simplex" machines.

I claim:

1. In a method of warp knitting that includes knitting a set of nonelastomeric threads in a knit stitch pattern from a first guide bar of a warp knitting machine and knitting a set of elastomeric threads in a knit stitch pattern from a second guide bar of the warp knitting machine; the improvement of which comprises: dividing said set of elastomeric threads into a plurality of sets of elastomeric threads and feeding said threads to a plurality of guide bars in a pattern; and knitting said plurality of guide bars in a repeating stitch pattern having a combination of a knit stitch and a laid-in stitch for each elastomeric thread.

2. The method of claim 1, wherein there is a plurality of said laid-in stitches with one knit stitch in a repeating pattern for each elastomeric thread.

3. The method of claim 1 wherein two sets of elastomeric threads are divided from one beam, one set being fed to said second guide bar and another set being fed to a third guide bar, and knit with a (1-0, 2-2, 0-0, 2-2) and with a (0-0, 2-2, 1-0, 2-2) stitch, respectively.

4. The method of claim 1, where there is a plurality of knit stitches with a plurality of laid-in stitches pattern for each elastomeric thread.

* * * * *